US010955224B1

(12) United States Patent
Theiss

(10) Patent No.: US 10,955,224 B1
(45) Date of Patent: Mar. 23, 2021

(54) NET PACKING METHOD AND DEVICE

(71) Applicant: Shawn M. Theiss, North Benton, OH (US)

(72) Inventor: Shawn M. Theiss, North Benton, OH (US)

( * ) Notice: Subject to any disclaimer, the term of this patent is extended or adjusted under 35 U.S.C. 154(b) by 0 days.

(21) Appl. No.: 16/813,458

(22) Filed: Mar. 9, 2020

Related U.S. Application Data

(60) Provisional application No. 62/815,543, filed on Mar. 8, 2019.

(51) Int. Cl.
*F41H 13/00* (2006.01)

(52) U.S. Cl.
CPC ..... *F41H 13/0006* (2013.01)

(58) Field of Classification Search
CPC ..... F41H 13/0006; F41A 9/35; F42B 6/00; F42B 12/58; F42B 12/66; F42B 12/68; B65H 54/56; B65H 54/58; B65H 54/60; B65H 54/62; B65H 54/585
USPC ..... 89/1.34; 102/504
See application file for complete search history.

(56) References Cited

U.S. PATENT DOCUMENTS 1,631,893 A * 6/1927 Schenck, Sr. ..... B65H 54/58 53/118
2,225,180 A * 12/1940 Olesen ..... B65H 54/58 242/118.4
2,426,592 A * 9/1947 Boyce ..... F42B 12/68 102/504
2,632,525 A * 3/1953 Schoeffler ..... G01F 11/003 55/477
3,203,637 A * 8/1965 Kaiser ..... B65H 54/585 242/571
3,954,226 A * 5/1976 Pickering ..... B60P 7/0846 242/395
3,971,525 A * 7/1976 Winslow ..... B65H 49/30 242/470
4,253,289 A * 3/1981 Cole ..... B65B 63/06 242/472.5
5,829,187 A * 11/1998 Weiser ..... A01M 1/16 43/116
6,158,686 A * 12/2000 Lawrence ..... B65H 54/58 242/129
6,170,416 B1 * 1/2001 Gulsby ..... D05B 43/00 112/279
6,381,825 B1 * 5/2002 Regis ..... F42B 12/70 102/505
6,606,839 B1 * 8/2003 Suda ..... B65B 63/024 53/430
7,072,560 B1 * 7/2006 Bramson ..... G02B 6/4457 385/134

(Continued)

*Primary Examiner* — Derrick R Morgan
(74) *Attorney, Agent, or Firm* — Zollinger & Burleson Ltd.

(57) ABSTRACT

An exemplary configuration of a net packing device includes a winding tool and a loading tool. In an exemplary method, the net is weaved onto the winding tool and then transferred to the loading tool. The net is pushed off of the loading tool into a net gun storage chamber configured to receive nets that are ready to launch. The winding and loading tools each have first and second prongs that are spaced apart the same distance so that the ends can be aligned. The net can be weaved about sleeves carried by the prongs of the winding tool. The net and sleeves are moved to the loading tool where the net is then pushed from the sleeves. In other exemplary configurations, only the loading tool is used.

17 Claims, 16 Drawing Sheets

(56) References Cited

U.S. PATENT DOCUMENTS

| | | | | |
|---|---|---|---|---|
| 10,894,603 | B2 * | 1/2021 | Lebaron | F41A 19/59 |
| 2007/0017095 | A1 * | 1/2007 | Bourne | B21F 27/00<br>29/890.03 |
| 2008/0023580 | A1 * | 1/2008 | Steeber | B65H 75/28<br>242/390.8 |
| 2013/0152508 | A1 * | 6/2013 | Solomon | B65D 75/02<br>53/430 |
| 2014/0061356 | A1 * | 3/2014 | Ott | B65H 54/56<br>242/472.7 |
| 2020/0130835 | A1 * | 4/2020 | Lebaron | F41H 13/0025 |

* cited by examiner

NET PACKING METHOD AND DEVICE

CROSS REFERENCE TO RELATED APPLICATIONS

This application claims the benefit of U.S. Provisional Application No. 62/815,543 filed Mar. 8, 2019; the disclosures of which are incorporated herein by reference.

BACKGROUND OF THE DISCLOSURE

1. Technical Field

The disclosure generally relates to devices and method for preparing nets for being launched from net guns and, more particularly to a device and method that provide consistency when folding and packing a net into a net launching device. Specifically, the disclosure relates to a device and method for packaging a net wherein the net is woven onto a tool that includes a plunger that helps remove the woven net from the device to its packed condition in a net launching device.

2. Background Information

Currently, net guns and net launching devices require a net to be folded and packed in a certain way to keep the net from becoming entangled or knotted when launched, and ultimately preventing the net from opening fully when launched at a target. Typically, the net is folded by hand requiring a certain amount of training and skill to do so successfully. Folded nets are used with net guns used for a variety of purposes including for shooting at people, animal, and flying vehicles such as UAVs.

SUMMARY OF THE DISCLOSURE

The net packing devices described herein are designed to reduce the required training and skill of the user, and to assure consistency when folding and packing a net into a net launching device. Methods of folding and packing nets for net guns are also disclosed.

One configuration of the net packing device includes winding and loading tools that cooperate for folding and packing the net. In this configuration, the first part, the winding tool, has a pair of prongs that extend from a base with a movable guide that slides a guide plate along the prongs. Sleeves are slidably carried on the prongs and the guide plate can push the sleeves off of the prongs. The second part, the loading tool, includes a base with two prongs spaced apart the same distance as the prongs of the winding tool. The prongs of the loading tool are also smaller than the sleeves so that the sleeves can be transferred from the prongs of the winding tool to the prongs of the loading tool. The loading tool also include a plunger that slides through the base of the loading tool. The plunger can have an end that defines a recess that is used to engage the wrapped net to push it off of the loading tool. The plunger can extend past the ends of the prongs and the sleeves.

Another configuration of the net packing device uses only the loading tool to wrap and load the net without the loading tool.

One exemplary method provides for weaving the net onto a pair of spaced sleeves carried on a pair of spaced prongs. After the net is woven onto the sleeves, the sleeves and net are transferred to another tool with another set of prongs.

The sleeves are then aligned into the cavity where the net is to be stored and a plunger pushes the woven net off of the sleeves into the cavity.

Another exemplary method provides for weaving the net directly onto the sleeves carried by the loading tool. When the weave is started from the inner ends of the sleeves on the winding part, the weave is reversed compared to the weave above. The weave can cross itself or be around the sleeves.

Another exemplary method provides for weaving the net directly onto the sleeves carried by the loading tool but starting from the outer ends of the sleeves and working towards the inner ends of the sleeves.

BRIEF DESCRIPTION OF THE DRAWINGS

Similar numbers refer to similar parts through the specification.

DETAILED DESCRIPTION OF THE DISCLOSURE

Figure 1:
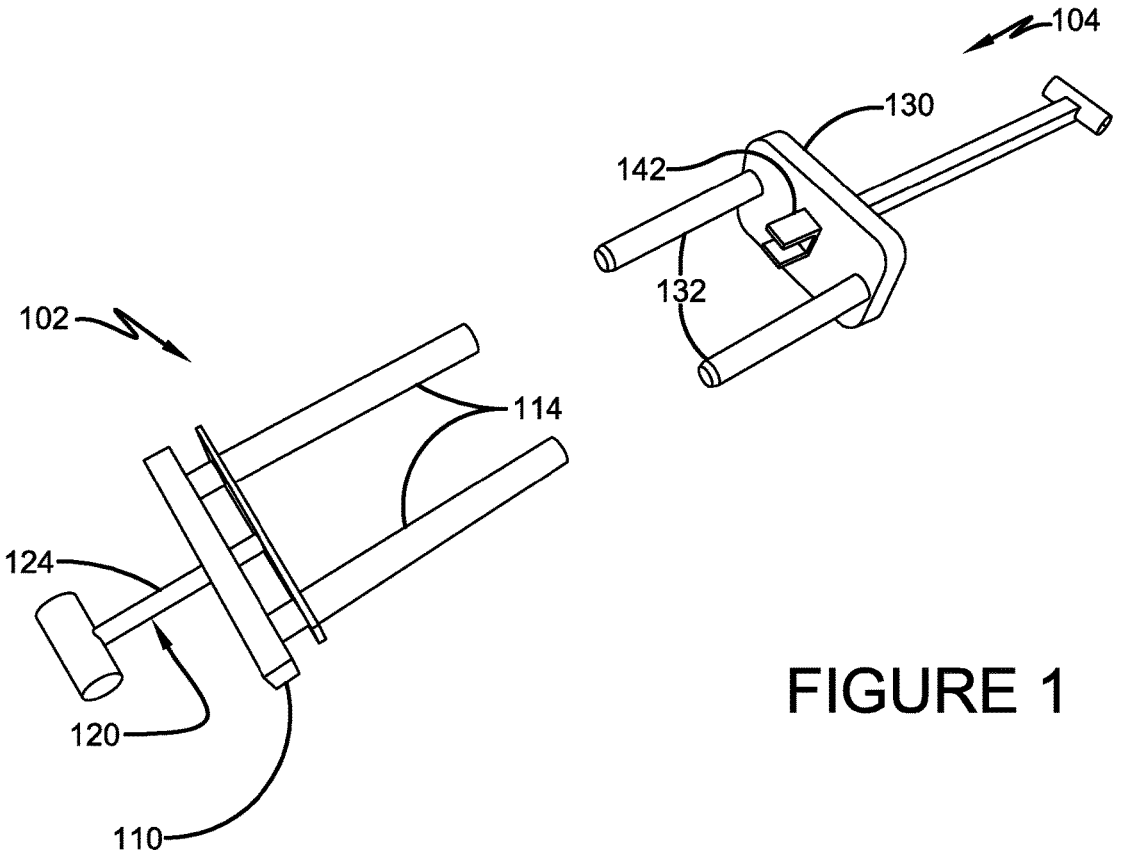
FIG. 1 is a perspective view of the winding and loading tools of a first exemplary configuration of the net packing device.

A first exemplary configuration of a net packing device is depicted in FIG. 1 and includes a winding tool 102 and a loading tool 104 with are provided as separate elements of the net packing device. A second exemplary configuration of a net packing device includes only loading tool 104. Tools 102 and 104 can be made from wood, metal, or a polymer. This disclosure also provides three different exemplary methods for folding and packing a net into a net launching device. The first exemplary method requires the use of both winding tool 102 and loading tool 104, while the second and third exemplary methods require only the use of loading tool 104.

Figure 34:
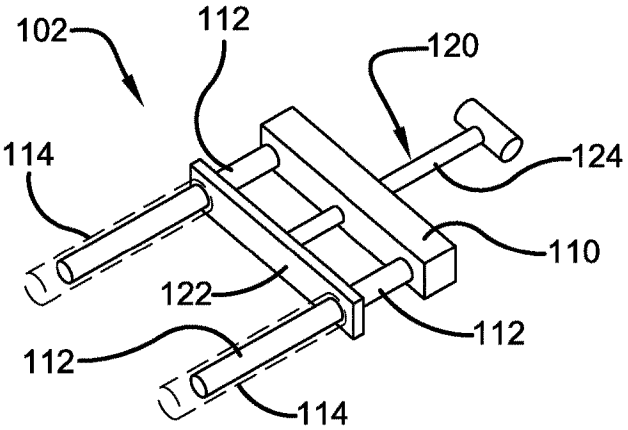
FIG. 34 is a perspective view of the winding tool.
Figure 33:
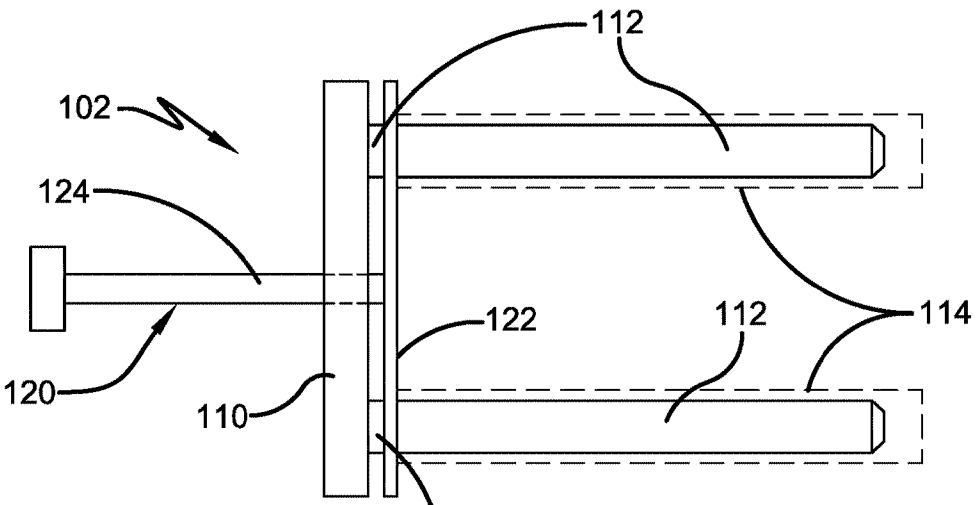
FIG. 33 is a top plan view of the winding tool.
Figure 35:
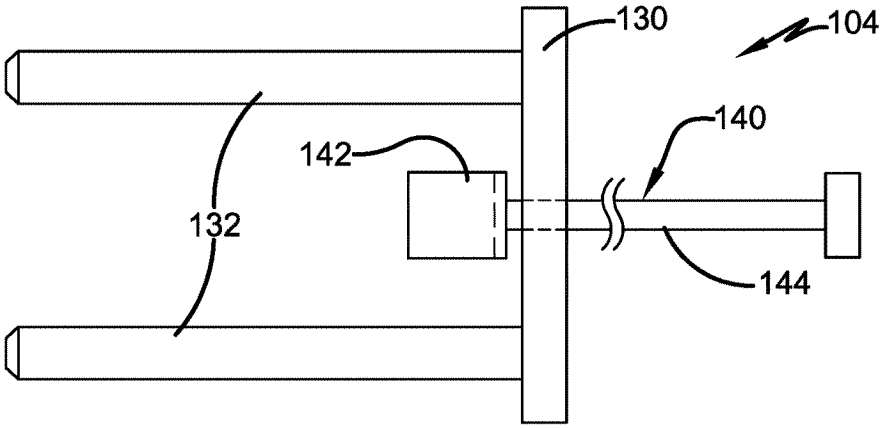
FIG. 35 is a top plan view of the loading tool.
Figure 36:
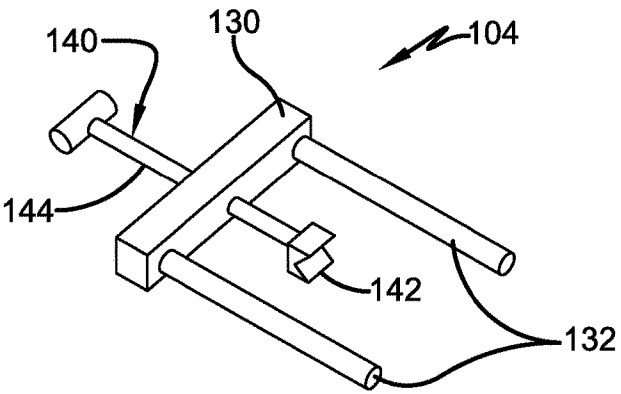
FIG. 36 is a perspective view of the loading tool.

Turning to FIGS. 33 and 34, winding tool 102 of the net packing device includes a base 110 from which two spaced prongs 112 extend in a substantially parallel configuration. Each prong 112 can have a constant, circular cross section along its length. The spacing of prongs 112 is configured to match the receiving cavity of the net head/net storage area of the net gun. A sleeve 114 is slidably carried on each prong 112. A transfer guide 120 includes a guide plate 122 and a handle 124. Guide plate 122 define a hole for each prong 112 with each hole being smaller than the inner end of each sleeve 114 so that each sleeve 114 abuts the outwardly-facing surface of guide plate 122 so that guide plate 122 can push sleeves 114 off of prongs 112. Sleeves 114 are longer than prongs 112. The outer surfaces of sleeves 114 is smooth to allow the net to slide off of the sleeve when needed. Sleeves 114 can be plastic or metal. Handle 124 extends through base 110 and is connected to or abuts guide plate 122 so that movement of handle through base 110 moves guide plate 122 down prongs 112 to simultaneously push sleeves 114 down prongs 112. Handle 124 is shorter than prongs 112 so that guide plate 122 is not pushed entirely off of prongs 112. Sleeves 114 are generally longer than prongs 112 so that the outer ends of prongs 112 do not extend through the outer ends of sleeves 114 when guide 120 is fully retracted as depicted in FIG. 33. This allows the outer ends of sleeves 114 to receive the outer ends of prongs 132 from loading tool 104.

Figure 2:
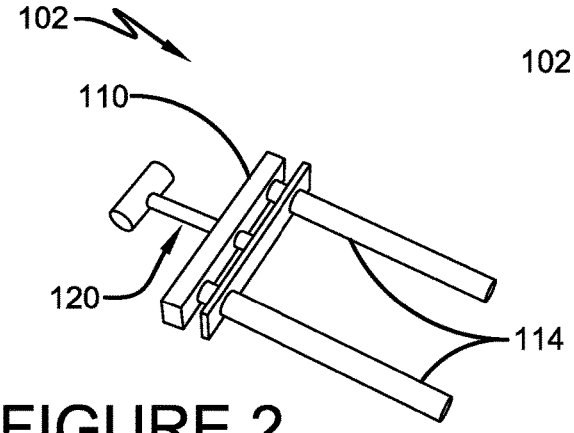
FIG. 2 is a perspective view of the winding tool with the guide mostly retracted.
Figure 3:
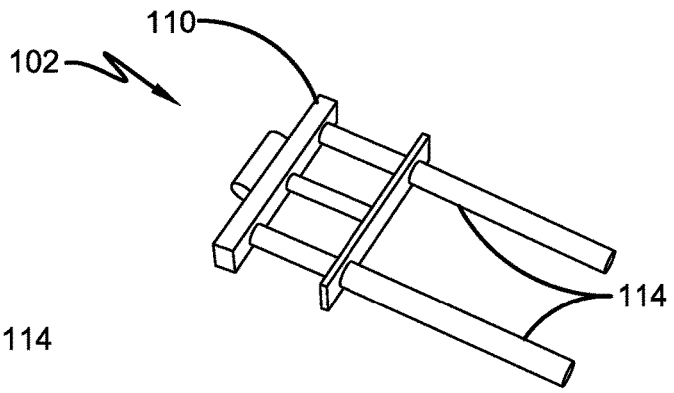
FIG. 3 is a perspective view of the winding tool with the guide extended with the sleeves pushed down the prongs.

FIG. 2 depicts a retracted position or condition of winding tool 102 with FIG. 3 depicting the extended position or condition of winding tool 102.

Loading tool 104 includes a base 130 with two spaced prongs 132 extending from base 130 in a substantially parallel configuration. Each prong 132 has a constant, circular cross section along its length. Prongs 132 are spaced apart about the same distance as prongs 112 so that the outer ends of prongs 112 and 132 can be aligned. This also allows the outer ends of sleeves 114 to be aligned with the outer ends of prongs 132. Prongs 132 are sized to slide within sleeves 114. When sleeves 114 and prongs 132 are round, the outer diameter of prongs 132 is smaller than the inner diameter of sleeve 114. Sleeves 114 can frictionally engage prongs 132 to help frictionally retain sleeves 114 when the net is pushed off of tool 104. Sleeves 114 can be longer than prongs 132. Loading tool 104 includes a plunger 140 with a head 142 and a handle 144. Handle 144 is longer than prongs 132 and sleeves 114 so that head 142 can be pushed out beyond the outer ends of prongs 132 and sleeves 114. Head 142 defines a concave recess that receives a portion of the wrapped net. This concave recess extends from edge to edge on head 142 and is used to capture and push the net off of loading tool 104.

Figure 4:
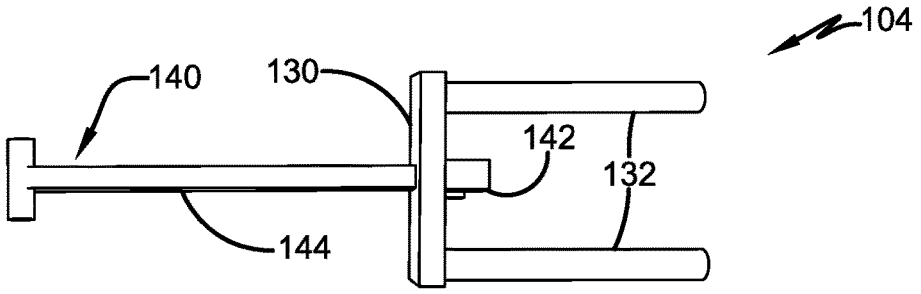
FIG. 4 is a perspective view of the loading tool with its plunger retracted.
Figure 5:
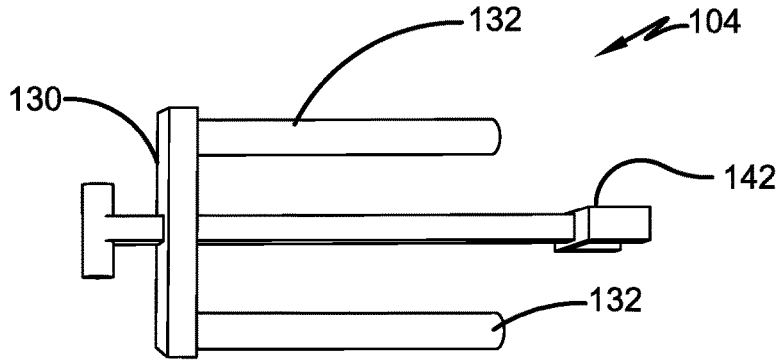
FIG. 5 is a perspective view of the loading tool with its plunger extended.

FIG. 4 depicts the retracted position or condition of plunger 140 and FIG. 5 depicts the extended position or condition of plunger 140.

In some embodiments, the lateral positions of prongs 112 and 132 on both tools 102 and 104 can be adjusted to allow the device to be readily used with other net launching devices.

First Exemplary Method

A first exemplary method of loading a net into a net launching device is described by the following steps using winding tool 102 and loading tool 104.

Figure 6:
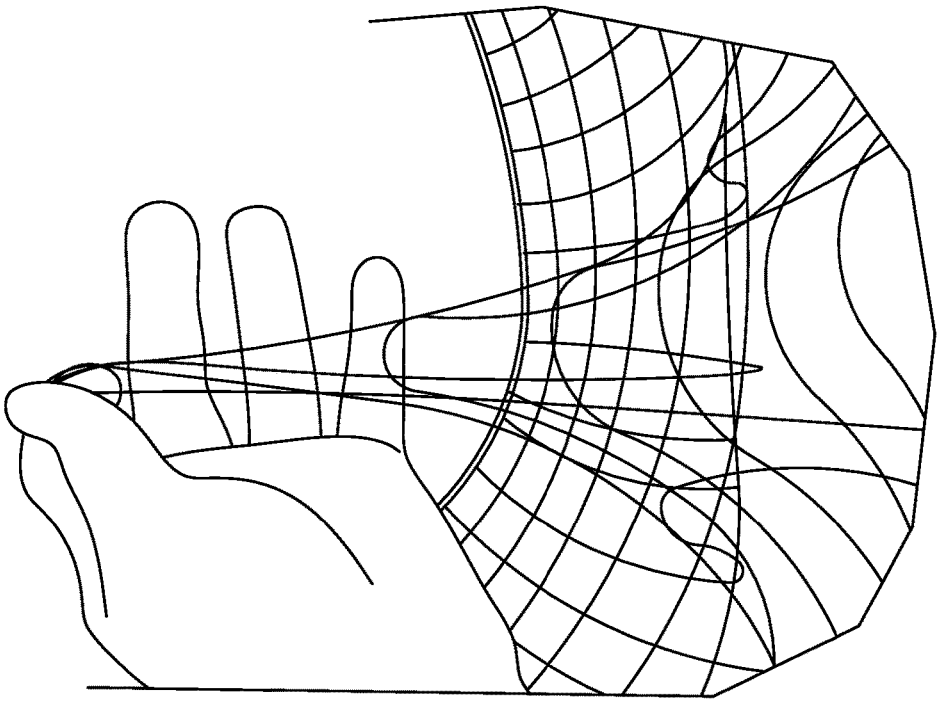
FIGS. 6-19 depict the steps of the first exemplary method.
Figure 7:
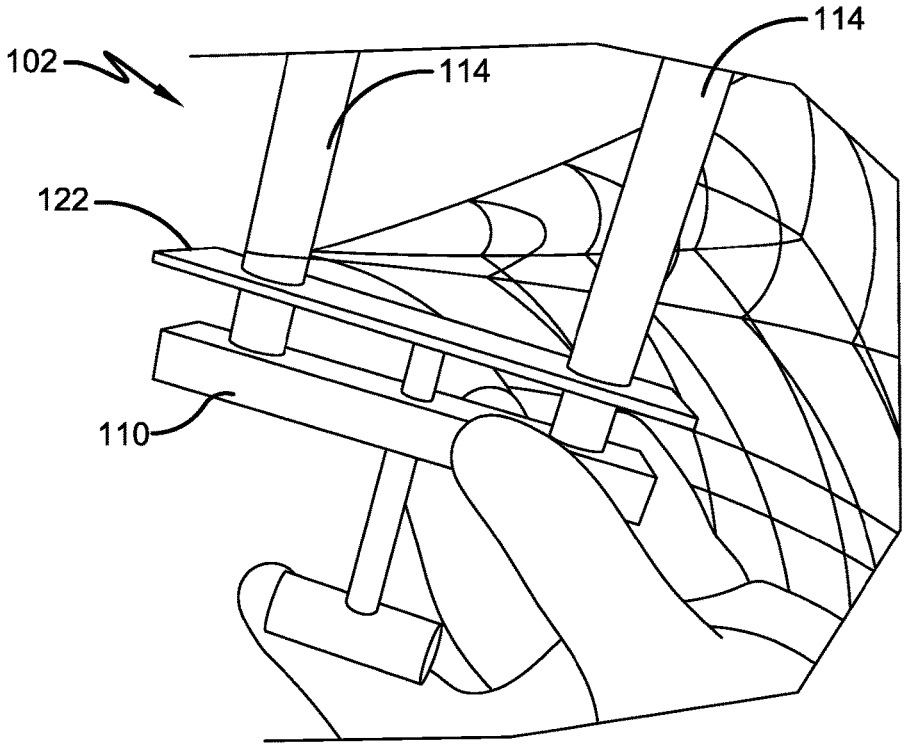
Figure 8:
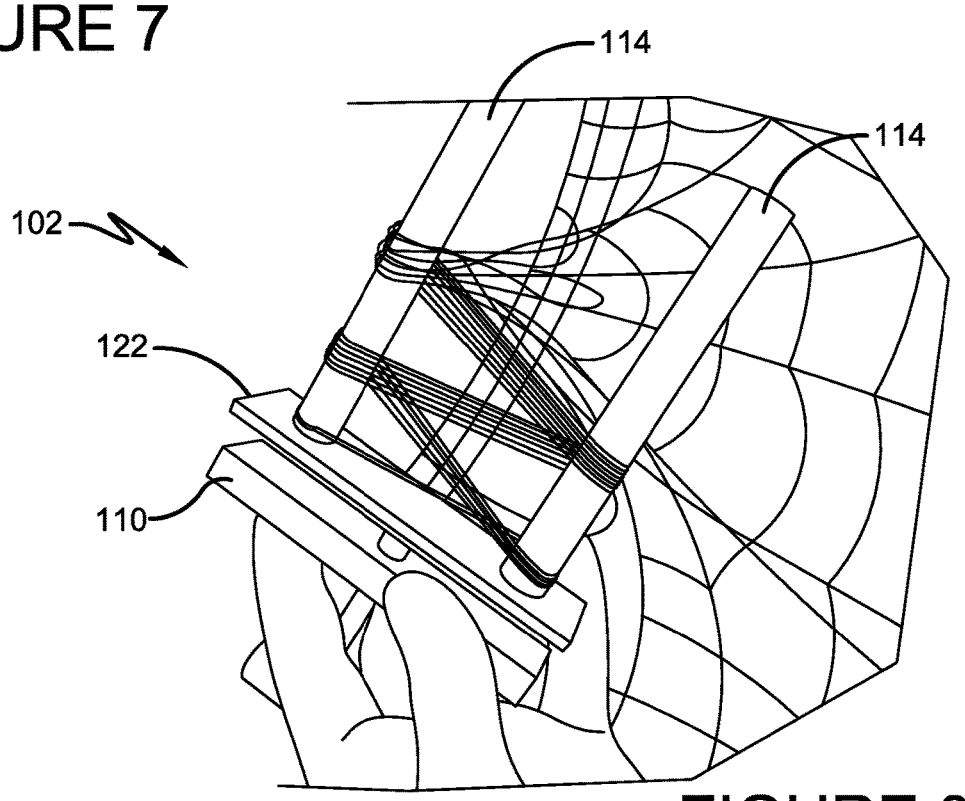
Figure 9:
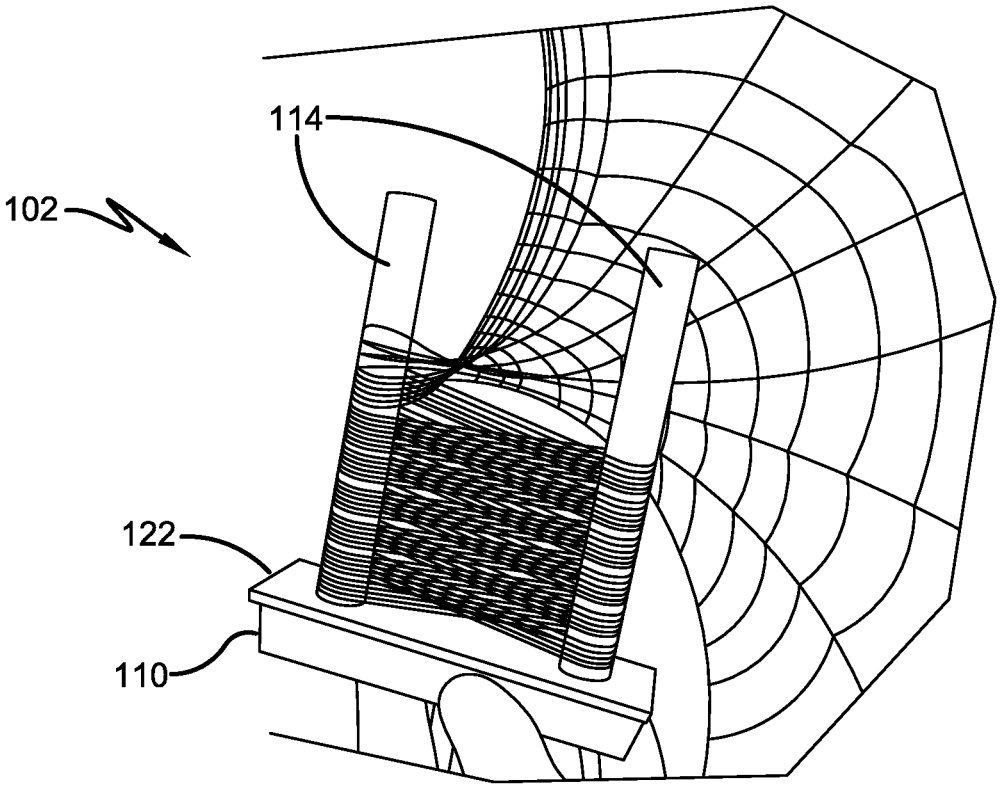
Figure 10:
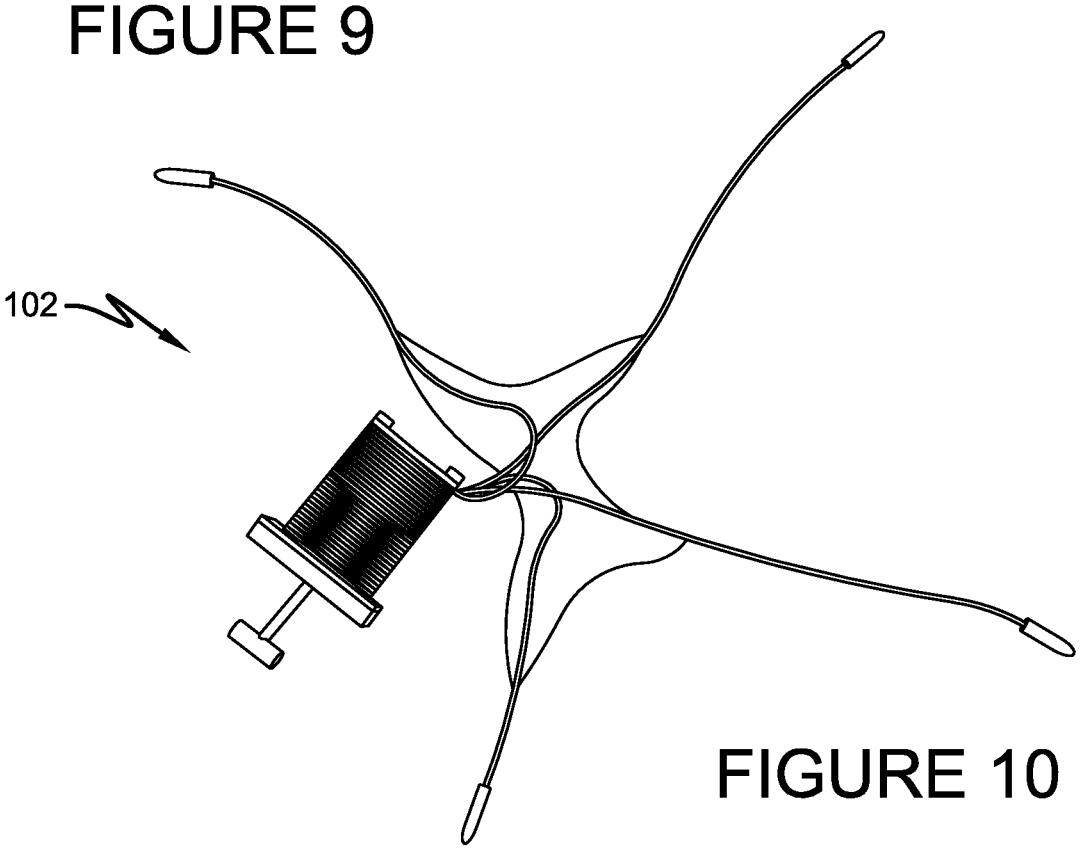
Figure 11:
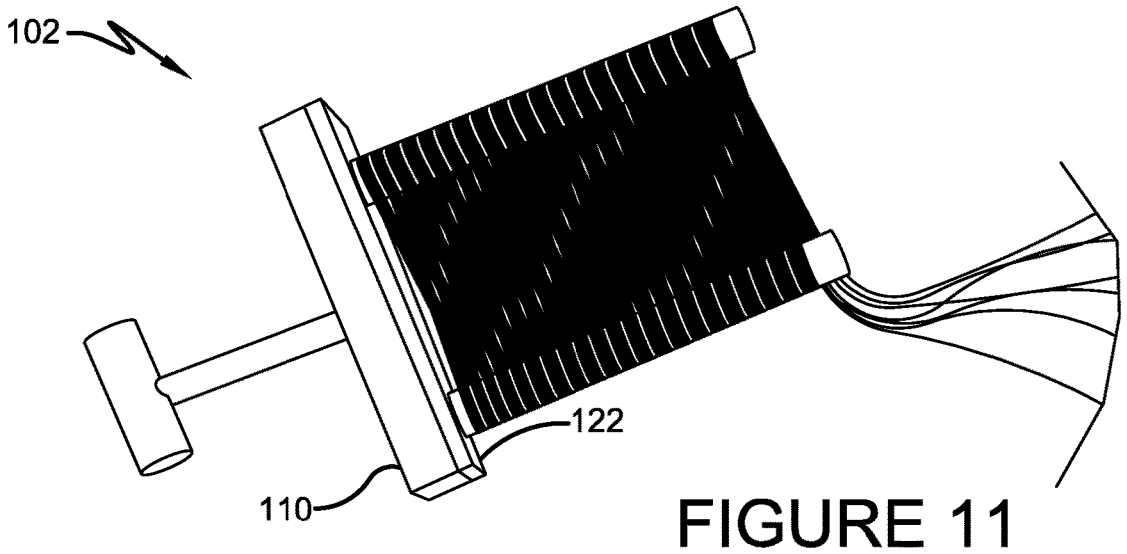
Figure 12:
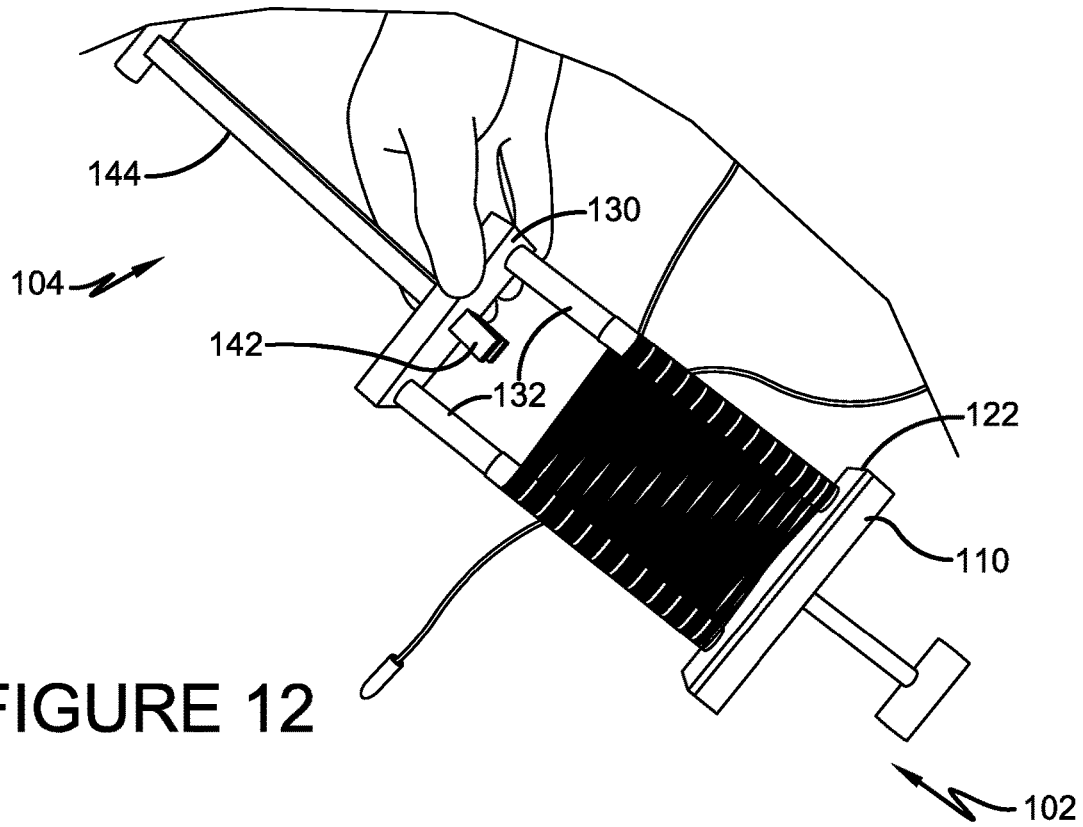
Figure 13:
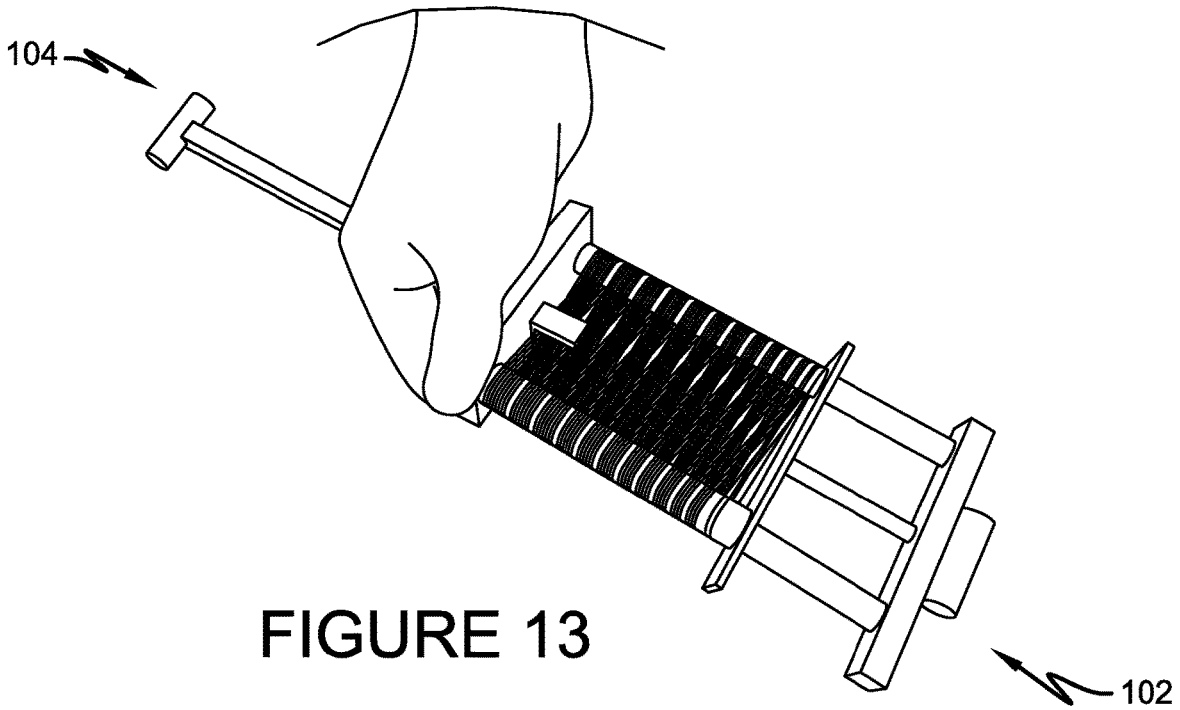
Figure 14:
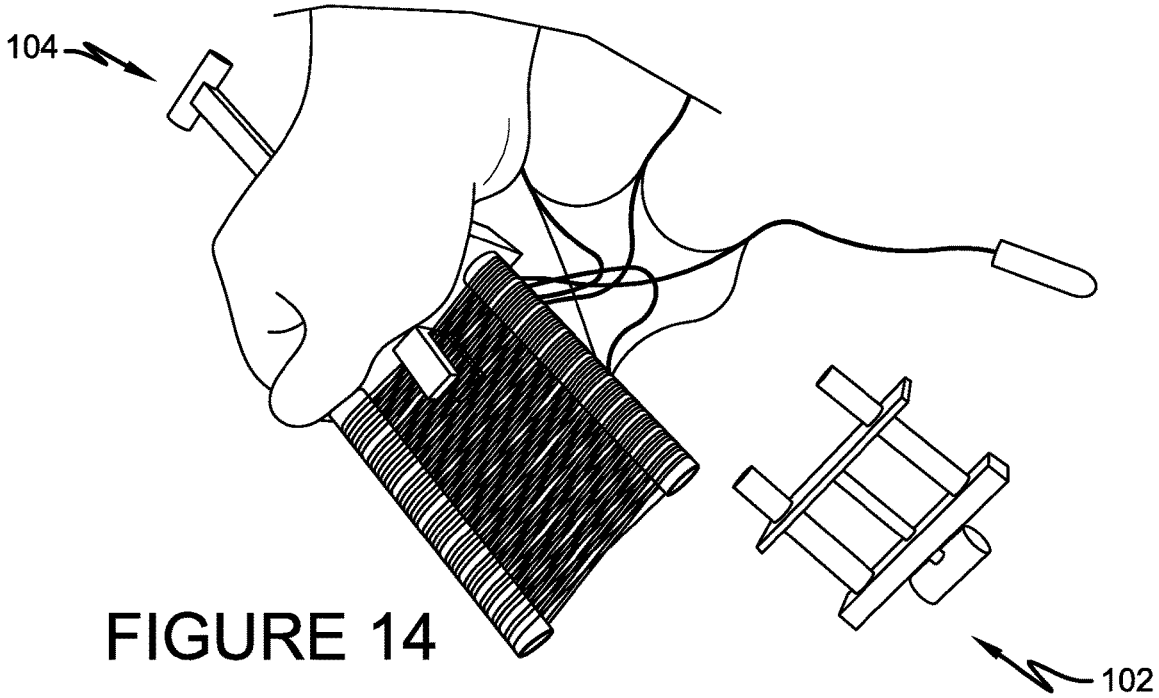
Figure 15:
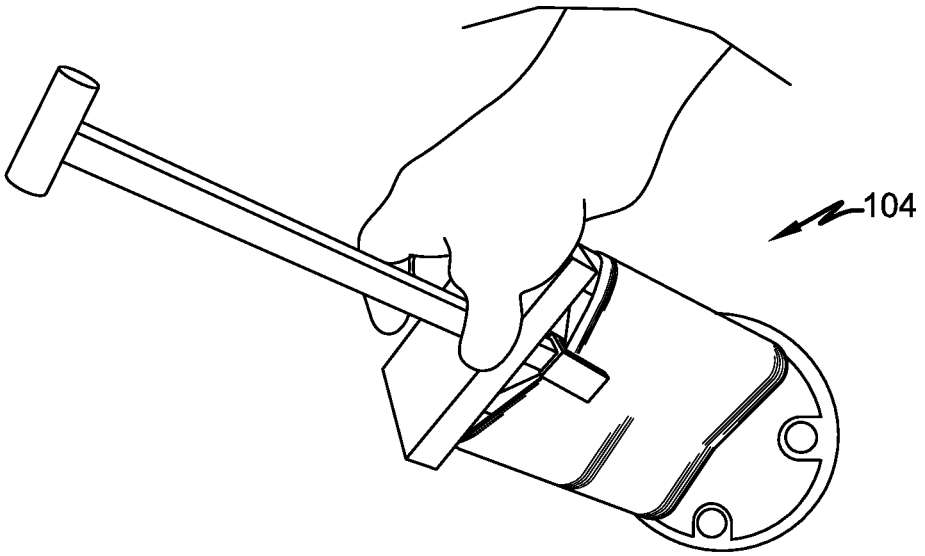
Figure 16:
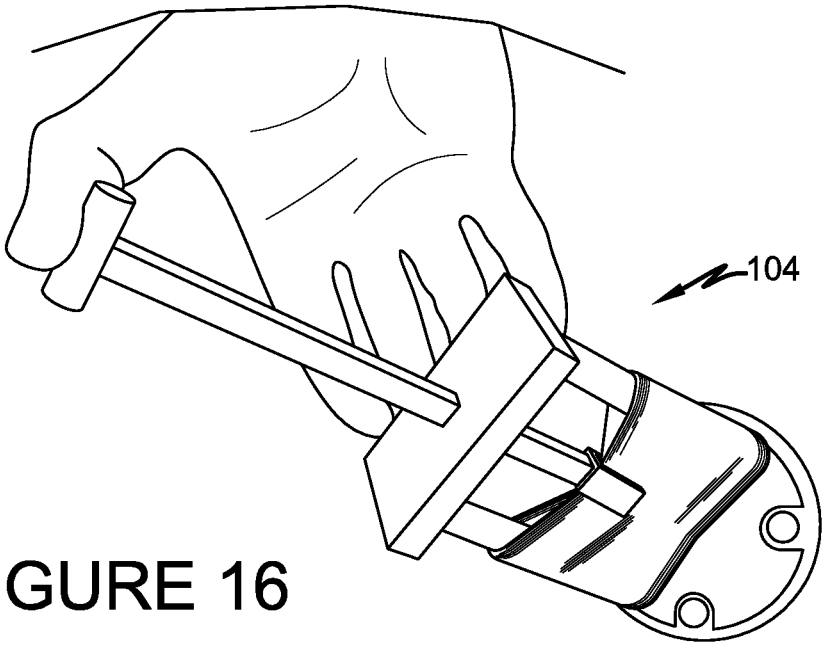
Figure 17:
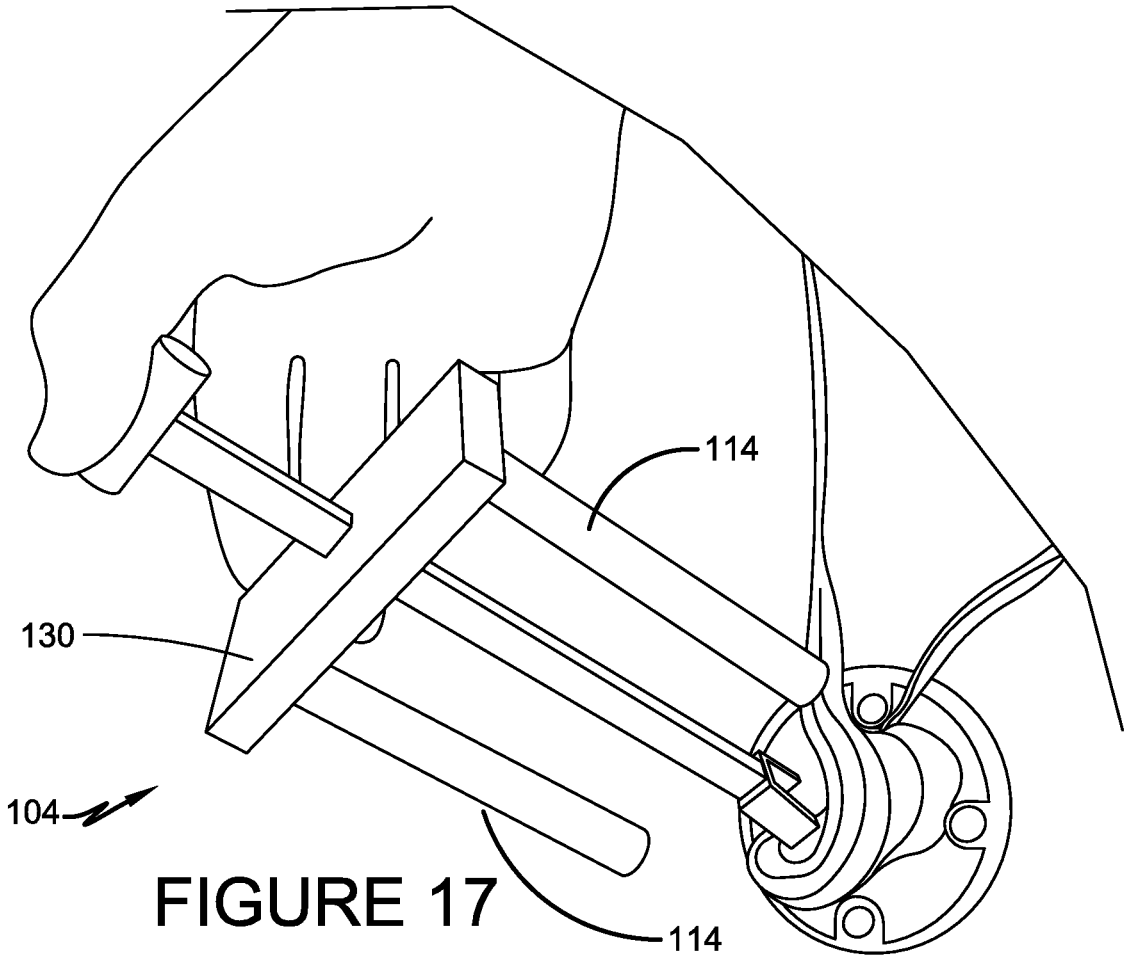
Figure 18:
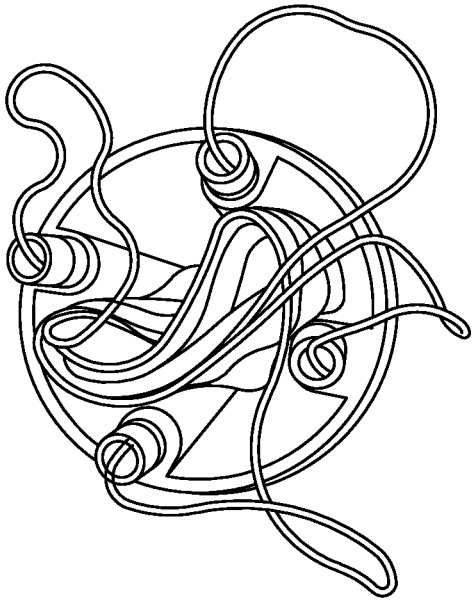
Figure 19:
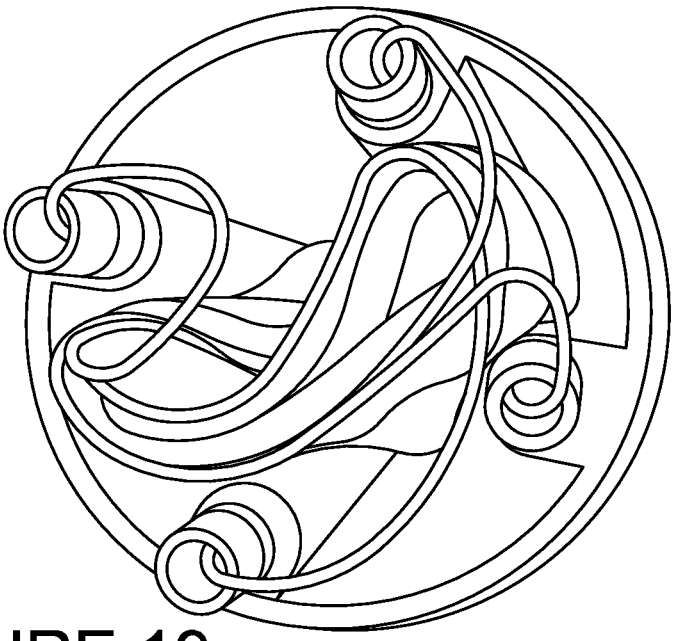
Figure 29:
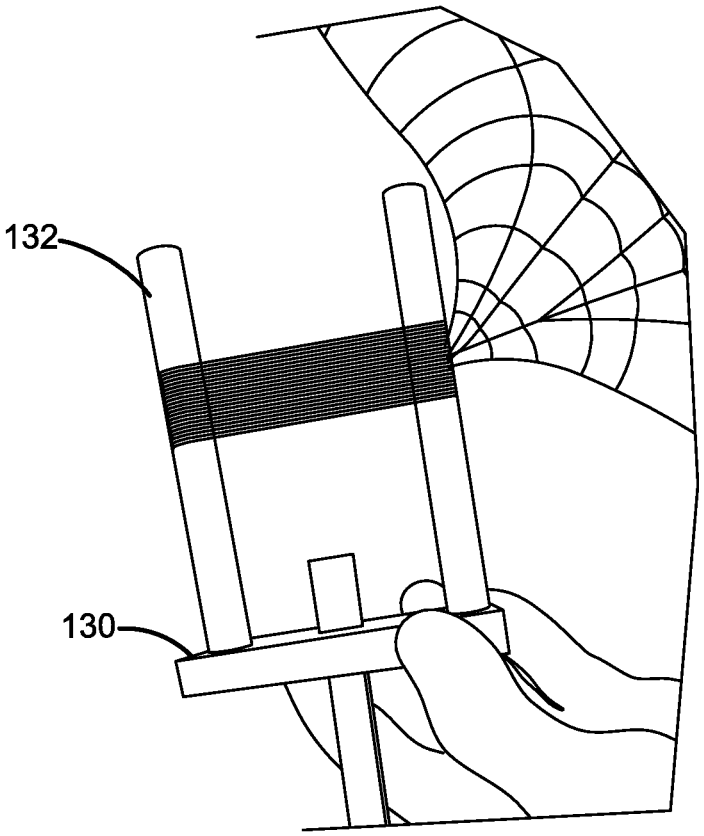
Figure 30:
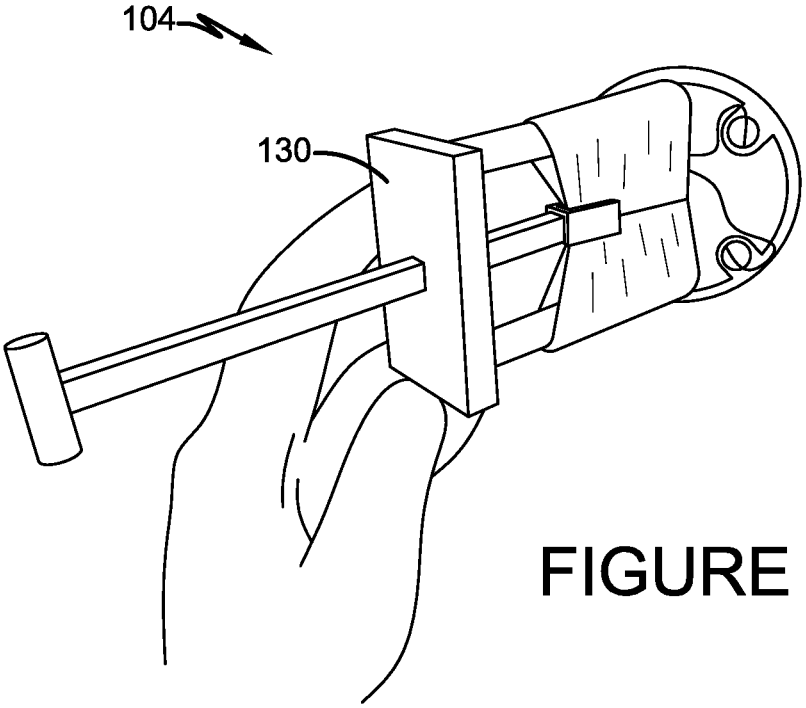

1. Find the center of the net (FIG. 6).
2. Loop the center of the net on to one of the sleeves 114 on one of the prongs 112 of winding tool 102 towards the top or inner end of the sleeve 114 (FIG. 7).
3. Begin to weave the net between the two sleeves 114, crossing back and forth (FIG. 8). In FIG. 8, the weave starts on top of the first prong and wraps under the bottom of the second prong and exits the second prong from the top and crosses over to the bottom of the first prong—compare to FIGS. 29-30 where the weave extends from the top of one prong to the top of the other prong. The weave of this step can be of either type.
4. Continue to weave the net between the two sleeves assuring the net does not weave on top of itself (FIG. 9).
5. Weave the net until all but the net ends are on the sleeves (FIG. 10).
6. Assure net weave is snug against itself, but not overlapping itself (FIG. 11).
7. Slide the loading tool prongs into the winding tool sleeves (FIG. 12).
8. Push the loading tool transfer guide down to its extended position until the sleeves and net transfer onto the prongs of the loading tool (FIG. 13).
9. Assure the sleeves are fully disposed on the prongs of the loading tool and that the loading tool head has the net in its concave recess (FIG. 14).
10. Place ends of sleeves at or in opening of net head or at or in the storage area to receive the folded net. (FIG. 15).
11. Push down on the loading tool plunger until it moves to the extended position (FIG. 16). Sleeves 114 are held against the device that is receiving the net.
12. Fully extend loading tool plunger until the net is seated into the receiving cavity of the net head/net storage area (FIG. 17). The user can hold sleeves 114 when removing loading tool 104.
13. Assure net corners are not crossing each other when corner weights are installed into the corner weight launch tubes (four corner weights are depicted in FIG. 18).
14. Carefully place the remaining net line into the net storage area by hand (FIG. 19).

Second Exemplary Method

A second exemplary method of loading a net into a net launching device is described by the following steps using loading tool 104.

Figure 20:
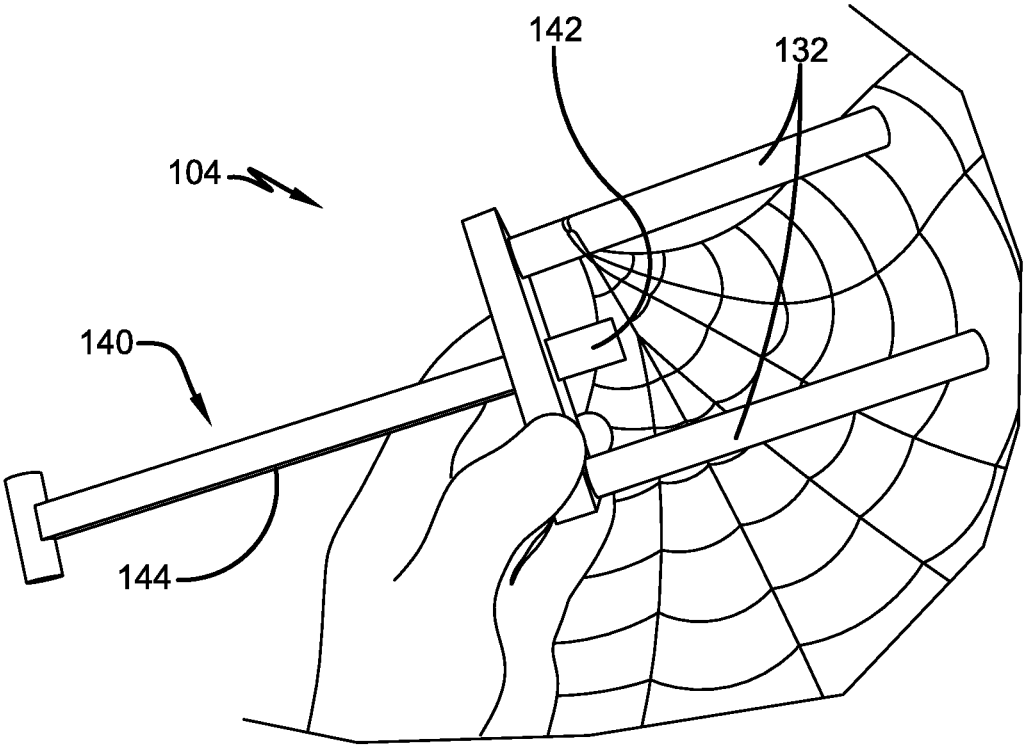
FIGS. 20-27 depict the steps of the second exemplary method.
Figure 21:
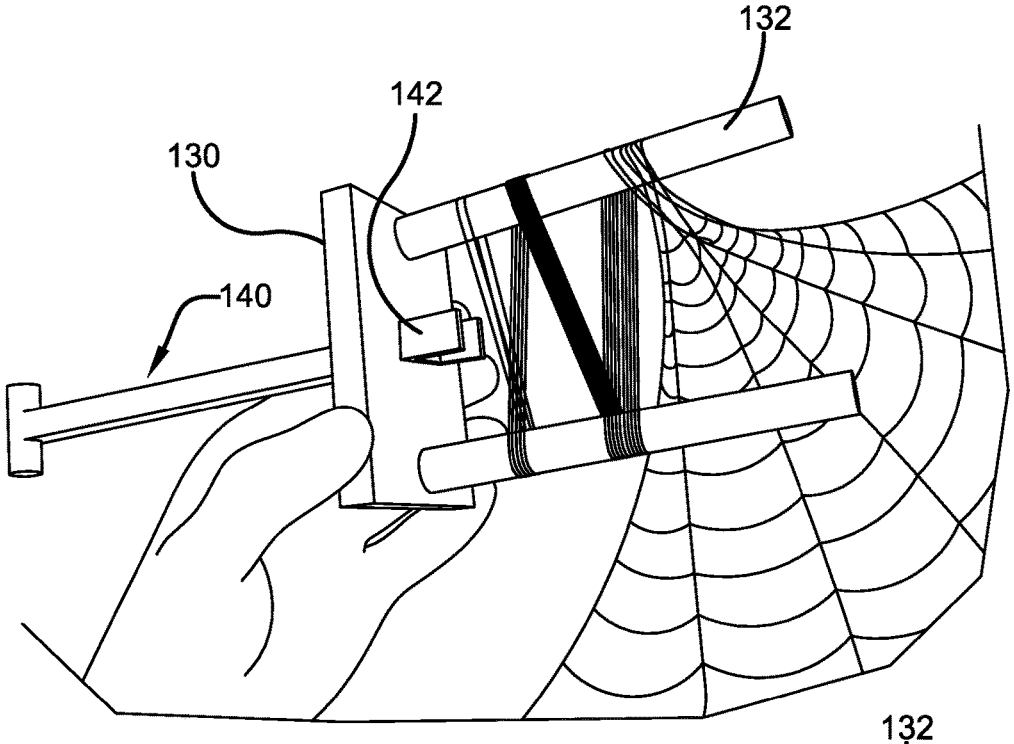
Figure 22:
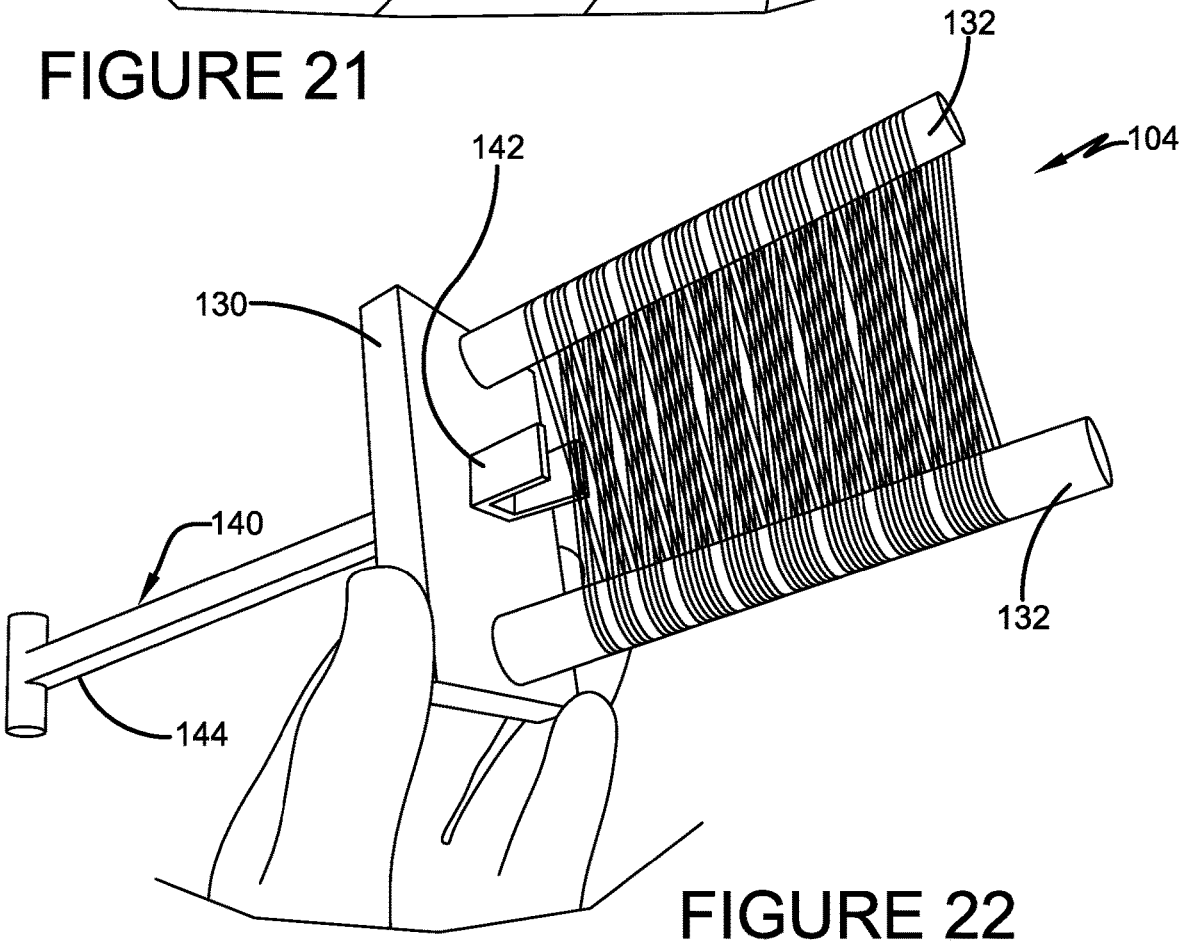
Figure 23:
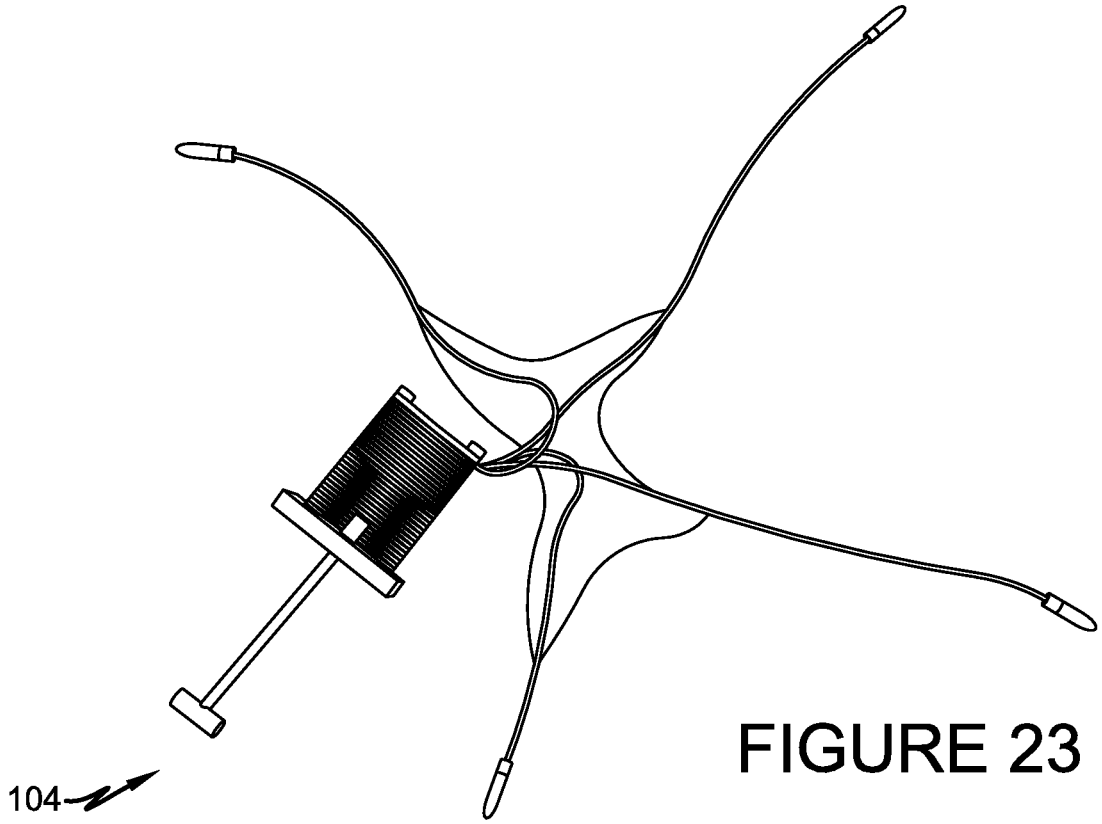
Figure 24:
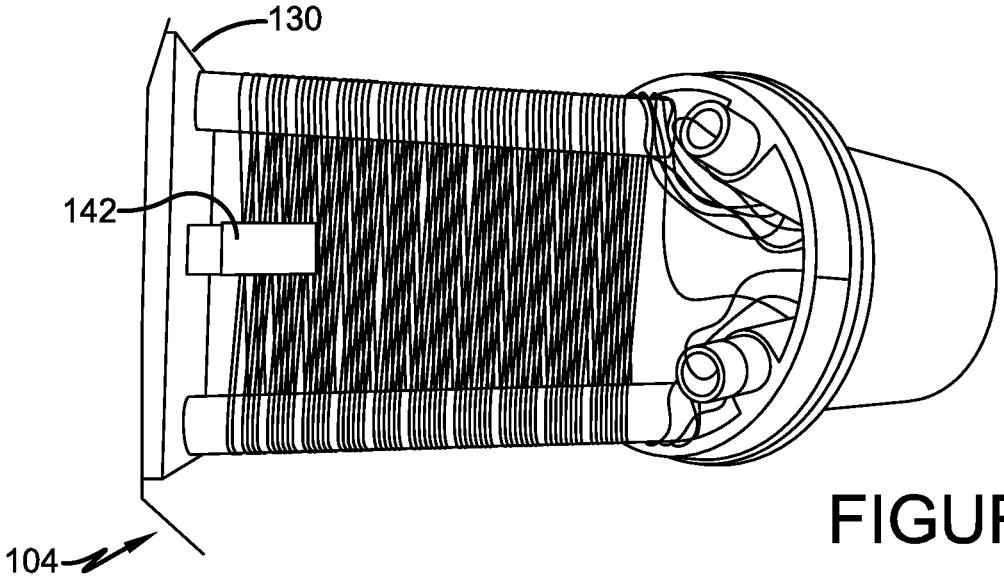
Figure 25:
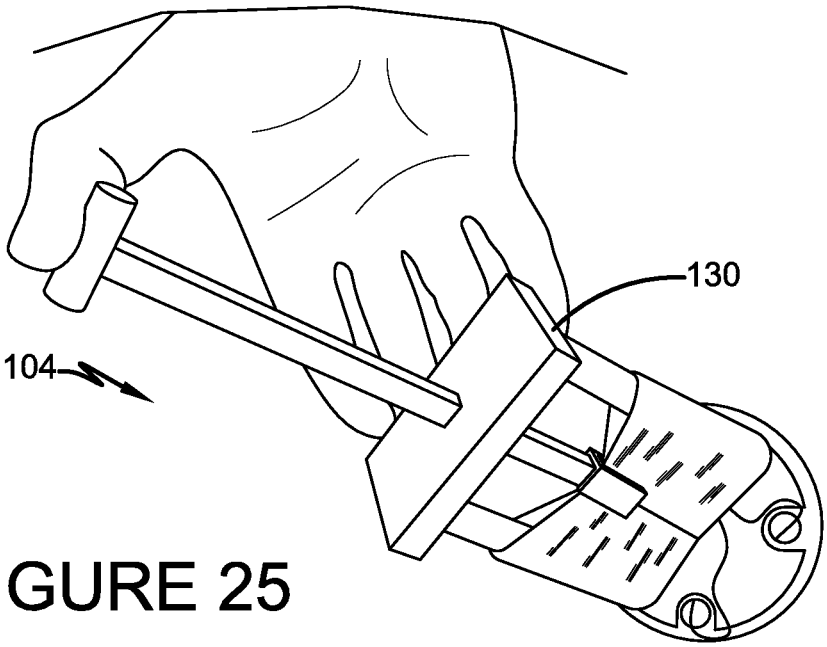
Figure 26:
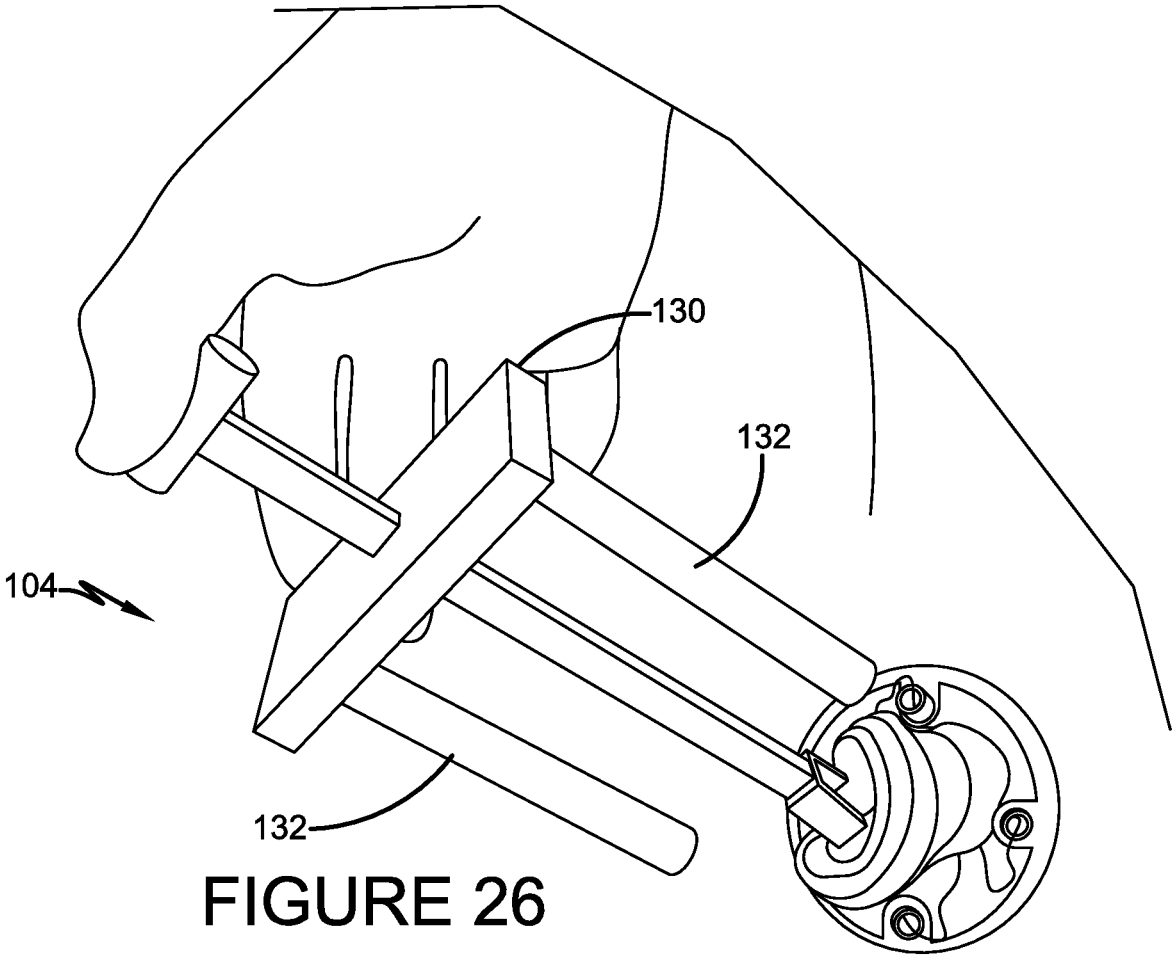
Figure 27:
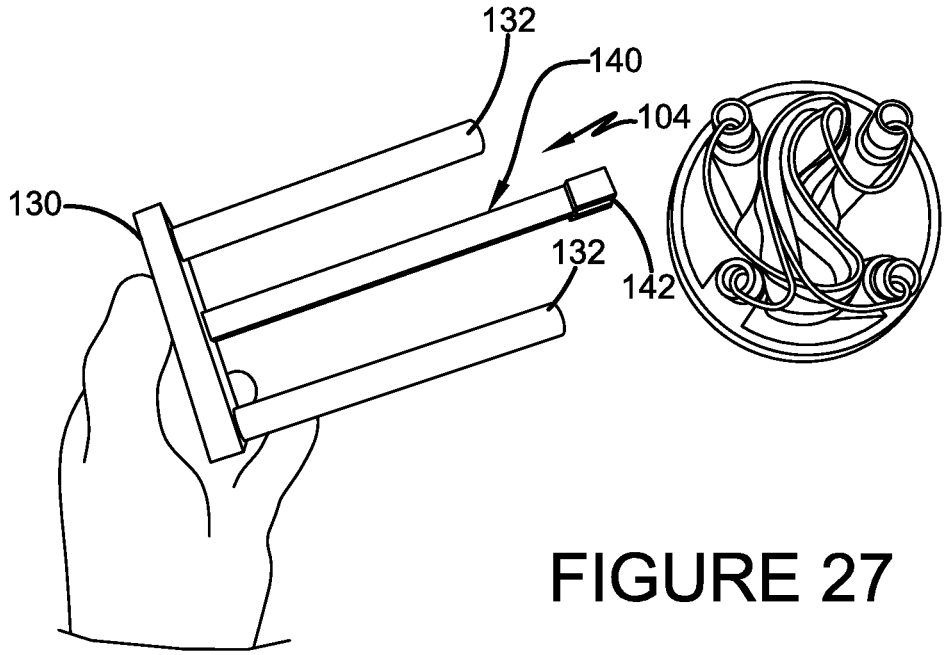

1. Find the center of the net (FIG. 6).
2. Optionally place sleeves 114 onto loading tool prongs 112 of loading tool 104. Loop the center of the net on to one of the sleeves on the prongs of the loading tool towards the top or inner end of the sleeve (FIG. 20). The net can be weaved onto prongs 132.
3. Begin to weave the net between the two sleeves, crossing back and forth (FIG. 21).
4. Continue to weave the net between the two sleeves assuring the net does not weave on top of itself (FIG. 22).
5. Weave the net until all but the net ends are on the sleeves (FIG. 23).
6. Assure the net is disposed in the concave recess of the head of the plunger and then place the outer ends of sleeves at or in opening of net head (or at or in the storage area to receive the folded net) (FIG. 24).
7. Push down on the loading tool plunger to its extended position (FIG. 25).
8. Fully extend the plunger until the net is seated into the receiving cavity of the net head/net storage area (FIG. 26).
9. Assure net corners are not crossing each other when corner weights are installed, then carefully place the remaining net line into the net storage area by hand (FIG. 27).

Third Exemplary Method

A third exemplary method of loading a net into a net launching device is described by the following steps using loading tool 104.

Figure 28:
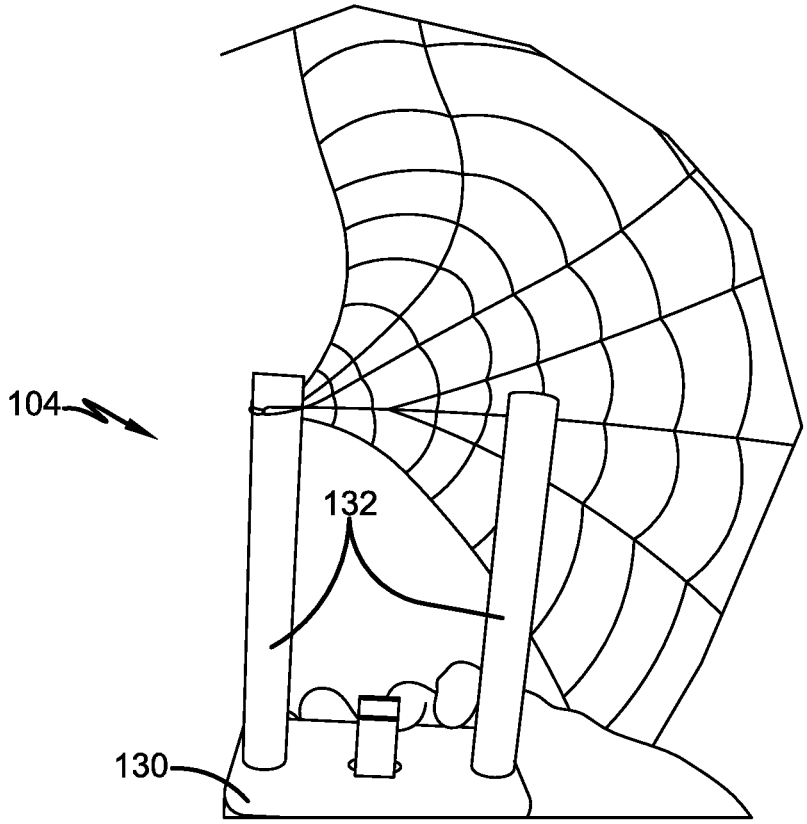
FIGS. 28-32 depict the step of the third exemplary method.
Figure 31:
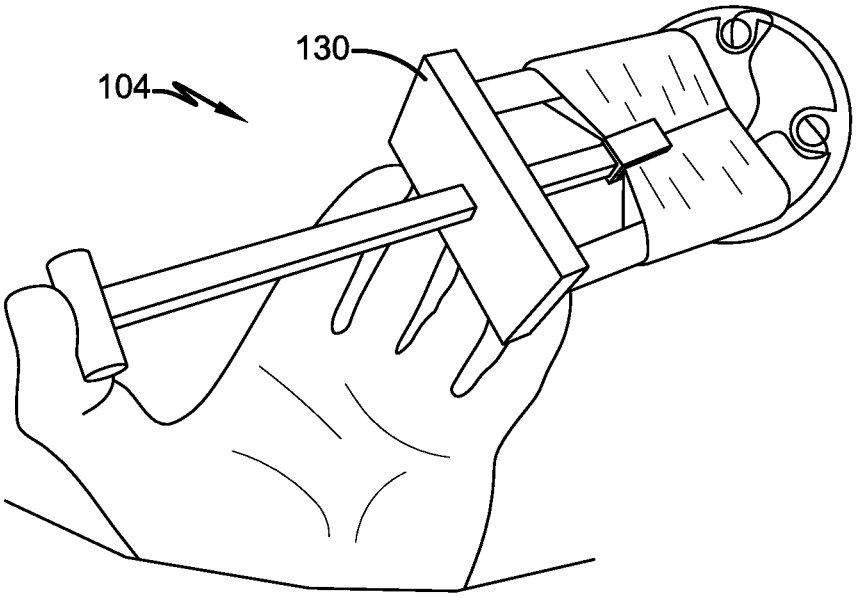
Figure 32:
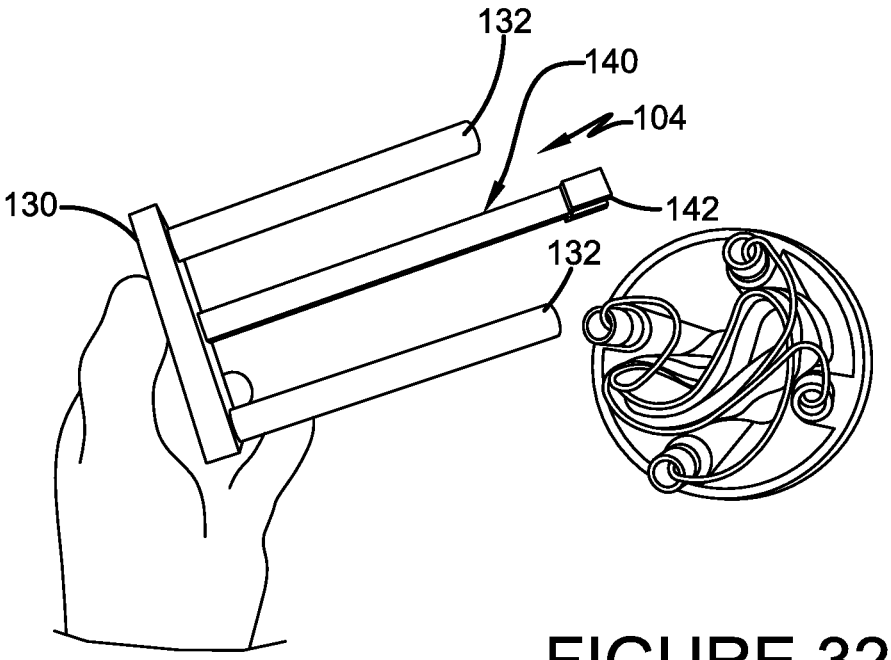

1. Find the center of the net (FIG. 6).
2. Loop the center of the net on to one of the sleeves on the prongs of the loading tool or loop the net directly onto the prongs of the loading tool towards the bottom or outer end of the sleeve or prong (FIG. 28).
3. Begin to wrap the net between the two sleeves or prongs, on the outside of the sleeves (FIG. 29).
4. Continue to wrap the net around the two sleeves or prongs assuring the net does not wrap on top of itself 5. Wrap the net until all but the net ends are on the sleeves or prongs.
6. Assure the net is disposed in the concave recess of the plunger head and then place ends of sleeves or the prongs at or in the opening of net head (or at or in the storage area to receive the folded net) (FIG. 30).
7. Push down on the loading tool plunger to move it to towards its extended position (FIG. 31).
8. Fully extend the loading tool plunger until the net is seated into the receiving cavity of the net head/net storage area (FIG. 32).
9. Assure net corners are not crossing each other when corner weights are installed, then carefully place the remaining net line into the net storage area by hand (FIG. 32).

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A net packing device for loading a net gun, comprising:

a loading tool base;

first and second spaced loading tool prongs extending from the loading tool base; the prongs being adapted to receive a net weaved about the prongs; the first loading tool prong being spaced from the second loading tool prong by a first distance; the first distance is configured to match the receiving cavity of a net storage area of a net gun; and a movable plunger slidably carried by the loading tool base intermediate the loading tool prongs.

2. The device of claim 1, further comprising a head carried on the plunger intermediate the loading tool prongs; the head defining a concave recess.

3. The device of claim 1, further comprising a sleeve carried by each of the loading tool prongs.

4. The device of claim 3, wherein each sleeve is longer than each loading tool prong.

5. The device of claim 4, wherein the plunger is longer than the sleeves.

6. The device of claim 1, wherein the first and second loading tool prongs are substantially parallel.

7. The device of claim 6, wherein each loading tool prong has a constant circular cross section along its length.

8. The device of claim 1, wherein the plunger is longer than the first and second loading tool prongs.

9. The device of claim 1, further comprising a winding tool having a base, first and second winding tool prongs extending from the base, a sleeve disposed on each of the winding tool prongs; and a transfer guide movably carried by the base of the winding tool.

10. The device of claim 9, wherein the transfer guide includes a guide plate that engages each of the sleeves and being adapted to push the sleeves off of the winding tool prongs.

11. The device of claim 10, wherein each of the winding tool prongs passes through the guide plate.

12. The device of claim 9, wherein each of the sleeves is longer than each of the winding tool prongs.

13. The device of claim 12, wherein the winding tool prongs are parallel.

14. The device of claim 13, wherein each of the winding tool prongs has a constant circular cross section along its length.

15. The device of claim 9, wherein the first and second winding tool prongs are spaced apart by the first distance.

16. A method of packing a net in a net storage area of a net gun; the method comprising the steps of:

weaving a net about a pair of sleeves carried on first and second winding tool prongs of a winding tool;

aligning the first and second loading tool prongs of a loading tool with the sleeves of the winding tool;

transferring the sleeves and net onto the first and second loading tool prongs; the first and second loading tool prongs spaced apart by a distance configured to match the receiving cavity of the net storage area; and pushing the net off of the sleeves with a plunger carried by the loading tool.

17. The method of claim 16, wherein the step of transferring the sleeves and net onto the first and second loading tool prongs is achieved by pushing the sleeves off of the winding tool with a loading guide carried by the winding tool.

* * * * *